US009892833B2

(12) United States Patent
Jeong

(10) Patent No.: US 9,892,833 B2
(45) Date of Patent: Feb. 13, 2018

(54) MAGNETIC POWDER AND COIL ELECTRONIC COMPONENT CONTAINING THE SAME

(71) Applicant: SAMSUNG ELECTRO-MECHANICS CO., LTD., Suwon-si, Gyeonggi-do (KR)

(72) Inventor: Dong Jin Jeong, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 15/149,858

(22) Filed: May 9, 2016

(65) Prior Publication Data

US 2017/0032880 A1 Feb. 2, 2017

(30) Foreign Application Priority Data

Jul. 31, 2015 (KR) ..... 10-2015-0108681

(51) Int. Cl.

| | |
|---|---|
| ***H01F 1/24*** | (2006.01) |
| ***H01F 17/00*** | (2006.01) |
| ***H01F 27/29*** | (2006.01) |
| *H01F 17/04* | (2006.01) |

(52) U.S. Cl.

CPC ..... *H01F 1/24* (2013.01); *H01F 17/0013* (2013.01); *H01F 27/292* (2013.01); *H01F 2017/048* (2013.01)

(58) Field of Classification Search

None

See application file for complete search history.

(56) References Cited

U.S. PATENT DOCUMENTS

| | | | | |
|---|---|---|---|---|
| 5,063,011 | A * | 11/1991 | Rutz | B22F 1/0059 148/105 |
| 7,622,202 | B2 * | 11/2009 | Maeda | B22F 1/02 428/405 |
| 9,067,833 | B2 * | 6/2015 | Rowe | C04B 35/62807 |
| 2002/0040077 | A1 * | 4/2002 | Hanejko | B22F 1/02 523/451 |
| 2008/0253917 | A1 * | 10/2008 | Hirose | B22F 1/0059 419/66 |

(Continued)

FOREIGN PATENT DOCUMENTS

| | | | | |
|---|---|---|---|---|
| JP | 2002170707 | A * | 6/2002 | H01F 41/0246 |
| JP | 2010-232224 | A | 10/2010 | |
| JP | 2012-049203 | A | 3/2012 | |

OTHER PUBLICATIONS

Machine Translation of JP 2010-232224 A (pub. 2010).*

(Continued)

*Primary Examiner* — Kevin M Bernatz

(74) *Attorney, Agent, or Firm* — McDermott Will & Emery LLP

(57) ABSTRACT

A magnetic powder includes magnetic metal particles, a first insulating layer disposed on a surface of each magnetic metal particle and containing silicon (Si) and oxygen (O), and a second insulating layer disposed on the first insulating layer and containing phosphorus (P). A coil electronic component includes a body in which a coil part is disposed, and external electrodes connected to the coil part. The body of the coil electronic component contains the magnetic powder.

14 Claims, 4 Drawing Sheets

(56) References Cited

U.S. PATENT DOCUMENTS

2012/0274437 A1* 11/2012 Matsuura ..... H01F 1/14783
336/221
2016/0322139 A1* 11/2016 Ye ..... B22F 1/02

OTHER PUBLICATIONS

Machine Translation of JP 2012-049203 A (pub. 2012).*
Derwent Abstract of JP 2002-170707 (pub. 2002).*
Machine Translation of JP 2002-170707 A (pub. 2002).*

* cited by examiner

MAGNETIC POWDER AND COIL ELECTRONIC COMPONENT CONTAINING THE SAME

CROSS-REFERENCE TO RELATED APPLICATION

This application claims the benefit of priority to Korean Patent Application No. 10-2015-0108681, filed on Jul. 31, 2015 with the Korean Intellectual Property Office, the disclosure of which is incorporated herein by reference.

TECHNICAL FIELD

The present disclosure relates to a magnetic powder and a coil electronic component containing the same.

BACKGROUND

Among passive elements, a coil electronic component may include a coil part and a body enclosing the coil part, wherein the body may contain a magnetic material.

In this case, the magnetic material contained in the body may be contained in a form of magnetic powder, and in order to decrease an eddy current loss in a high frequency band, insulation between magnetic particles contained in the body should be secured.

Further, in a case in which the magnetic powder is metal based powder, there is an advantage in that a saturation magnetization value is high, but when an available frequency is increased, a core loss caused by the eddy current loss may be increased, and thus efficiency may be deteriorated.

SUMMARY

An aspect of the present disclosure may provide a magnetic powder and a coil electronic component containing the same.

According to an aspect of the present disclosure, a magnetic powder may contain magnetic particles and an insulating layer disposed on the magnetic particles in order to improve insulation properties between the particles contained in the magnetic powder. The insulating layer includes a first insulating layer containing silicon (Si) and oxygen (O) and a second insulating layer containing phosphorus (P) to thereby be composed of at least two layers.

The second glass may have a softening point lower than that of the first glass.

According to another aspect of the present disclosure, there are provided a method of manufacturing magnetic powder and a coil electronic component containing the magnetic powder.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
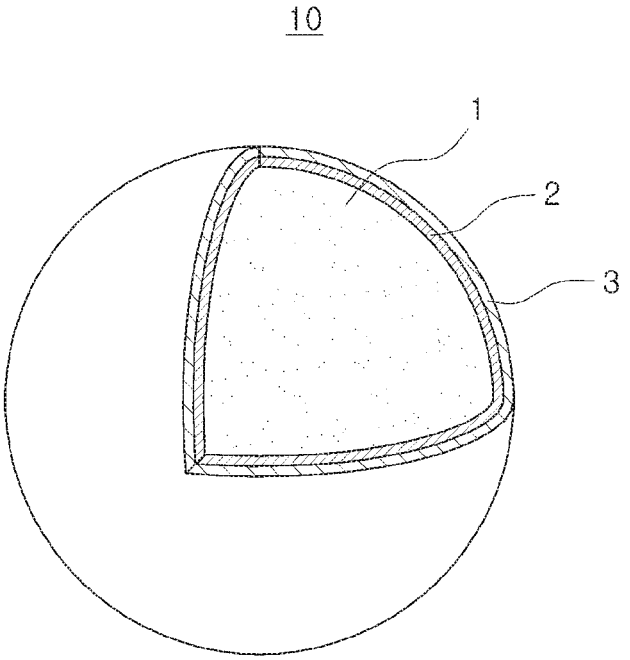
FIG. 1 is a partially cut perspective view illustrating one particle of magnetic powder according to an exemplary embodiment in the present disclosure.

Hereinafter, embodiments of the present inventive concept will be described as follows with reference to the attached drawings.

The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present inventive concept. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present inventive concept will be described with reference to schematic views illustrating embodiments of the present inventive concept. In the drawings, for example, due to manufacturing techniques and/or tolerances, modifications of the shape shown may be estimated. Thus, embodiments of the present inventive concept should not be construed as being limited to the particular shapes of regions shown herein, for example, to include a change in shape results in manufacturing. The following embodiments may also be constituted by one or a combination thereof.

The contents of the present inventive concept described below may have a variety of configurations and propose only a required configuration herein, but are not limited thereto.

Magnetic Powder and Method of Manufacturing the Same

FIG. 1 is a partially cut perspective view illustrating one particle of magnetic powder according to an exemplary embodiment in the present disclosure.

Referring to FIG. 1, magnetic powder 10 according to the exemplary embodiment may contain a metal particle 1 and insulating layers 2 and 3 disposed on the metal particle 1, wherein the insulating layers include first and second insulating layers 2 and 3 to thereby be composed of at least two layers.

According to the exemplary embodiment, the magnetic powder 10 may be used in a coil electronic component. For example, the magnetic powder 10 may be used in inductors, beads, filters, or the like, but is not limited thereto.

The metal particle 1 is not particularly limited as long as it has magnetic properties.

In a case in which the magnetic powder is formed of the metal particle, a saturation magnetic flux density may be high, and a decrease in L value may be prevented even at a high current.

For example, the metal particle 1 may contain at least one material selected from the group consisting of iron (Fe) based alloys. In a case in which the metal particle 1 is formed of the iron (Fe) based alloy, the metal particle may have a high saturation magnetization density. The iron (Fe) based alloy may be an amorphous alloy or a nano-crystalline alloy.

The iron (Fe) based alloy, which is obtained by adding at least one alloy element that is different from iron (Fe) to iron (Fe), may have properties of a metal. The alloy element is not particularly limited as long as it may increase electrical resistance. Further, the alloy element is not particularly limited as long as it may improve permeability, and may improve specific electrical resistance so as to be used at a high frequency. For example, the alloy element may include at least one of phosphorus (P), boron (B), silicon (Si), carbon (C), aluminum (Al), chromium (Cr), and molybdenum (Mo).

Although not limited, the iron (Fe) based alloy may be, for example, an Fe—Si—B based amorphous alloy or an Fe—Si—B based nano-crystalline alloy.

In a case in which the iron (Fe) based alloy is formed of the amorphous alloy or the nano-crystalline alloy, specific electrical resistance of the metal particle may be increased, and thus when the magnetic particles are applied to an electronic component, the electronic component may be used in a high frequency band.

Although not limited, a particle size of the metal particle 1 may be 1 μm to 100 μm. The insulating layer will be described below, but according to the exemplary embodiment, since the magnetic particle includes at least two insulation layers, even though the metal particle 1 has a small particle size of 1 μm to 100 μm, insulation properties may be implemented.

According to the exemplary embodiment, the first insulating layer 2 may be disposed on a surface of the metal particle 1, and the second insulating layer 3 may be disposed on the first insulating layer 2. According to one embodiment, the metal particle 1 may be completely surrounded by the first insulating layer 2, and the first insulating layer 2 may be completely surrounded by the second insulating layer 3.

The first insulating layer 2 may contain silicon (Si) and oxygen (O), and the second insulating layer 3 may contain phosphorus (P). According to the exemplary embodiment, the first insulating layer 2 may contain silicon (Si) and oxygen (O), and thus binding force with the metal particle 1 may be strong. Further, the second insulating layer 3 may contain phosphorus (P), and thus insulation properties may be additionally secured by a combination of silicon (Si) contained in the first insulating layer 2 and phosphorus (P).

Further, according to the embodiment, an Fe—Si—O bond is present in an interface between the metal particle 1 and the first insulating layer 2.

Further, according to the exemplary embodiment, even if the insulating layer does not have an increased thickness, the insulation properties may be secured by the combination of silicon (Si) and phosphorus (P) contained in the first and second insulating layers 2 and 3.

For example, according to the exemplary embodiment, each of the first and second insulating layers 2 and 3 may be formed to have a thickness of 30 nm or less. In this case, insulation resistance of the magnetic particle may be $10^{11}\Omega$ or more.

According to the exemplary embodiment, the first and second insulating layers 2 and 3 may be formed of glass. For example, the first insulating layer 2 may contain a first glass, and the second insulating layer 3 may contain a second glass, wherein the first glass and the second glass are formed of materials different from each other. In a case in which the first and second insulating layers 2 and 3 are formed of glass, the first glass may contain silicon (Si) and oxygen (O), and the second glass may contain phosphorus (P) in addition to silicon (Si) and oxygen (O).

Meanwhile, according to the exemplary embodiment, the first and second insulating layers 2 and 3 may have different specific electrical resistance values from each other.

In a case in which the first and second insulating layers 2 and 3 are formed of materials having different specific electrical resistance values from each other as described above, there is an advantage in that specific electrical resistance of the magnetic powder may be easily adjusted.

Figure 2:
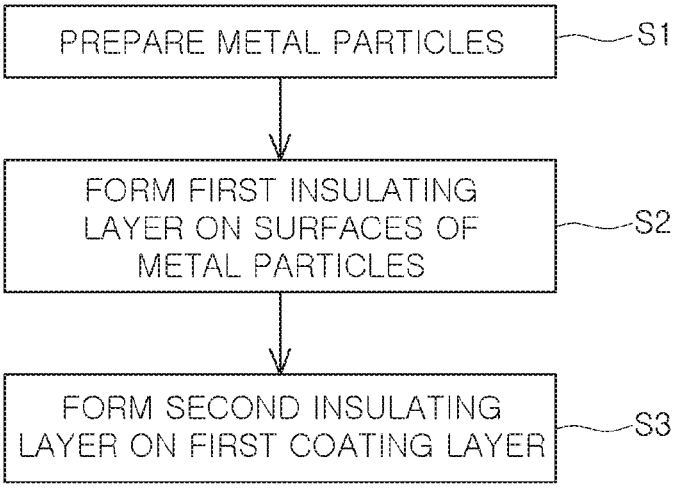
FIG. 2 is a flow chart illustrating a method of manufacturing magnetic powder according to an exemplary embodiment in the present disclosure.

FIG. 2 is a flow chart illustrating a method of manufacturing magnetic powder according to an exemplary embodiment in the present disclosure.

Referring to FIG. 2, the method of manufacturing magnetic powder according to the exemplary embodiment may include preparing metal particles (S1), forming a first insulating layer on surfaces of the metal particles (S2), and forming a second insulating layer on the first insulating layer (S3).

Although not limited, the first and second insulating layers may be formed by a spray method, a dipping method, or the like.

Further, in a case in which the first and second insulating layers are formed of glass, although not limited, the first and second insulating layers may be formed using a dry-coating device.

For example, the dry-coating device may include a chamber, a friction part disposed in the chamber and rapidly rotating based on a shaft as an axis, and a blade, and in a case in which the metal particle powder and glass powder are injected into the chamber, the glass powder may be adsorbed on surfaces of the metal particles while being softened by friction heat between the powders caused by high-speed rotation, thereby forming an insulating layer.

For example, the forming of the first insulating layer may be performed by softening first glass powder formed of a first glass using heat generated by mechanical friction and coating the softened first glass on the surface of the metal particle 1.

Further, for example, the forming of the second insulating layer may be performed by softening a second glass powder formed of second glass using heat generated by mechanical friction and coating the softened second glass on a surface of the first insulating layer of the metal particle.

Among descriptions of the method of manufacturing magnetic powder, a description of the same features as those of the magnetic powder according to the exemplary embodiment described above will be omitted in order to avoid an overlapping description.

Coil Electronic Component and Manufacturing Method Thereof

Figure 3:
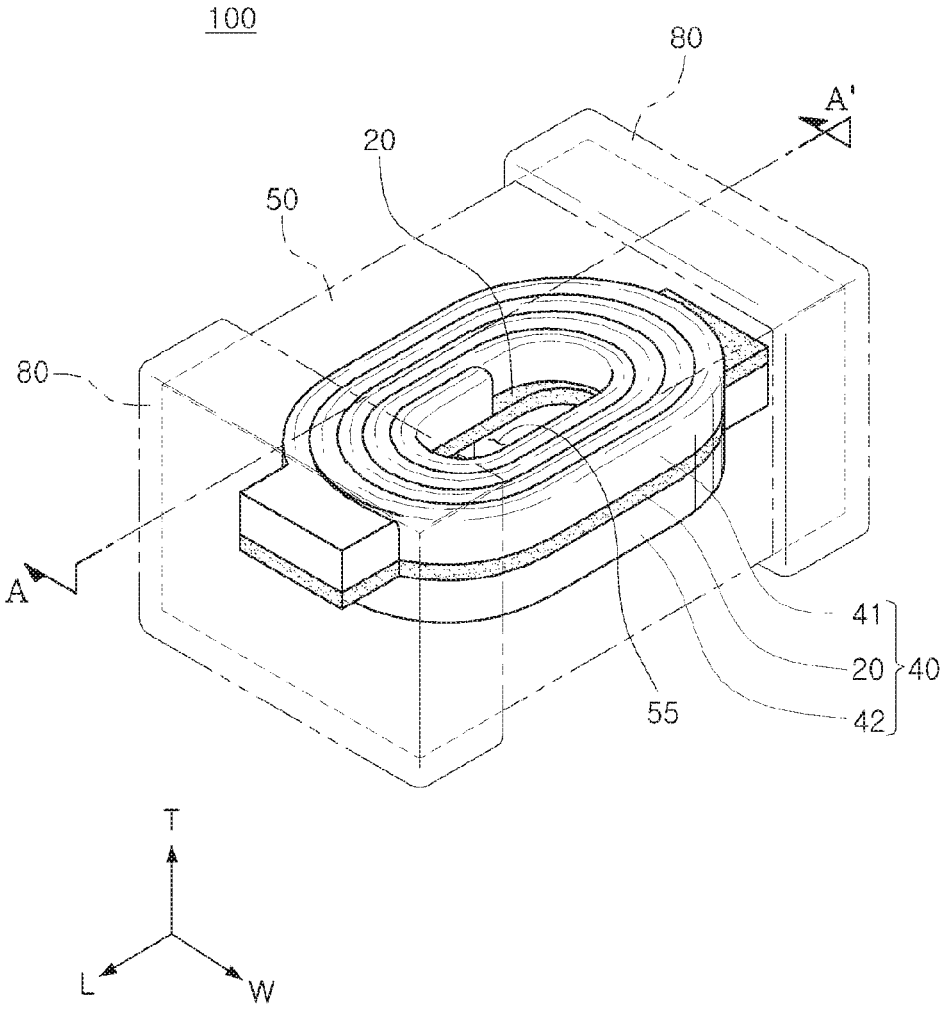
FIG. 3 is a schematic perspective view illustrating a coil electronic component according to an exemplary embodiment in the present disclosure so that a coil part disposed therein is visible.
Figure 4:
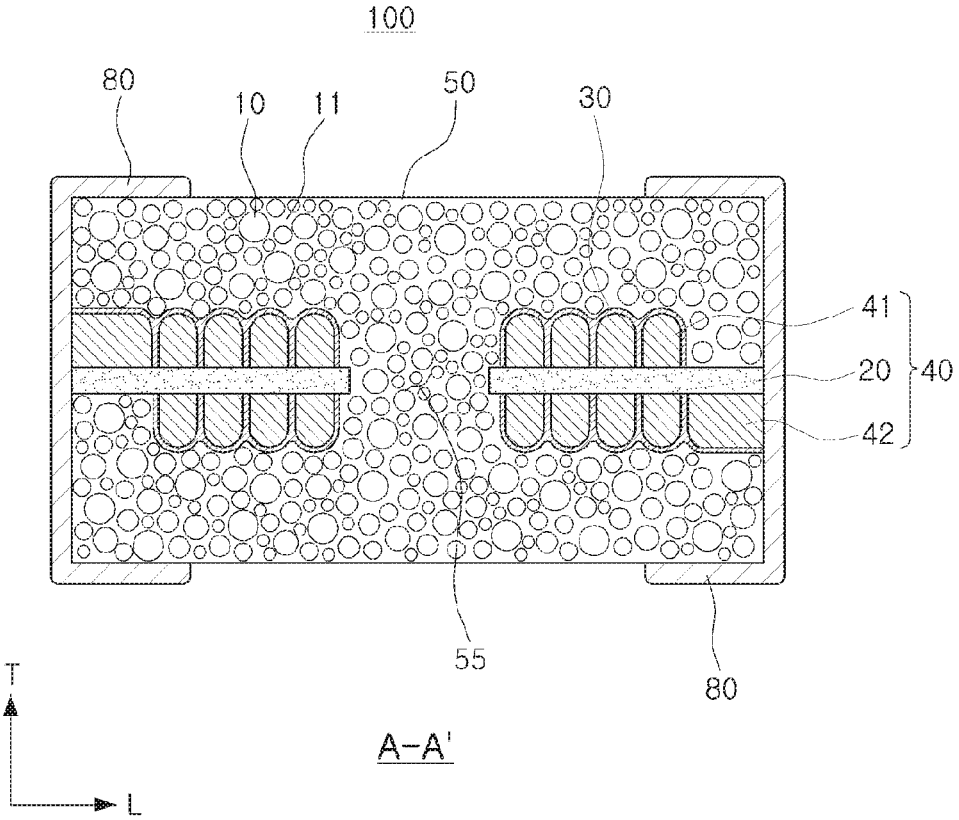
FIG. 4 is a cross-sectional view taken along line A-A' of FIG. 3.

FIG. 3 is a schematic perspective view illustrating a coil electronic component according to an exemplary embodiment in the present disclosure so that a coil part disposed therein is visible, and FIG. 4 is a cross-sectional view taken along line A-A' of FIG. 3.

Referring to FIGS. 3 and 4, an inductor used in a power supply line of a power supply circuit is illustrated as an example of the coil electronic component, but the coil electronic component according to the exemplary embodiment may be appropriately applied as beads, a filter, and the like, as well as the inductor.

In addition, a thin film type inductor will be described as an example of the inductor, but the coil electronic component is not limited thereto. That is, the coil electronic component according to the exemplary embodiment may be appropriately applied to a multilayer type inductor or a winding type inductor.

The coil electronic component 100 may include a body 50 and external electrodes 80, wherein the body 50 includes a coil part 40.

The body 50 may have a substantially hexahedral shape, and L, W, and T illustrated in FIG. 1 refer to a length direction, a width direction, and a thickness direction, respectively.

Although not limited, the body 50 may have first and second surfaces opposing each other in the thickness direction, third and fourth surfaces opposing each other in the length direction, and fifth and sixth surfaces opposing each other in the width direction. Although not limited, the body 50 may have a rectangular parallelepiped shape so that a length thereof in the length direction is greater than a length thereof in the width direction.

The body 50 may form an exterior of the coil electronic component 100, and may contain the magnetic powder according to the exemplary embodiment described above.

The magnetic powder may contain metal particles, a first insulating layer disposed on surfaces of the metal particles and containing silicon (Si) and oxygen (O), and a second insulating layer disposed on the first insulating layer and containing phosphorus (P).

Among descriptions of the magnetic powder contained in the body, a description of the same features as those of the magnetic powder according to the exemplary embodiment described above will be omitted in order to avoid an overlapping description.

The magnetic powder may be contained in the body 50 in a state in which the magnetic powder is dispersed on a polymer such as an epoxy resin, polyimide, or the like.

As illustrated in FIGS. 3 and 4, the coil part 40 may be disposed in the body 50. The coil part 40 may include a base layer 20 and coil patterns 41 and 42 disposed on at least one surface of the base layer 20.

The base layer 20 may contain, for example, polypropylene glycol (PPG), a ferrite, a metal-based soft magnetic material, or the like.

A through hole may be formed in a central portion of the base layer 20 and filled with the magnetic powder contained in the body 50, thereby forming a core part 55. As the core part 55 is formed by filling the through hole with the magnetic powder, inductance (L) of the inductor may be improved.

A first coil pattern 41 having a coil shape may be formed on one surface of the base layer 20, and a second coil pattern 42 having a coil shape may be formed on the other surface of the base layer 20 opposing one surface of the base layer 20.

The coil patterns 41 and 42 may be formed in a spiral shape on one surface and the other surface of the base layer 20, respectively, and may be electrically connected to each other through a via electrode (not illustrated) formed in the base layer 20.

Although not limited, one end portion of the first coil pattern 41 disposed on one surface of the base layer 20 may be exposed to one surface of the body 50 in the length direction, and one end portion of the second coil pattern 42 disposed on the other surface of the base layer 20 may be exposed to the other surface of the body 50 in the length direction.

The external electrodes 80 may be formed on outer surfaces of the body 50 to be connected to the exposed end portions of the coil patterns 41 and 42. In a case in which the exposed end portions of the coil patterns 41 and 42 are exposed to both surfaces of the body 50 in the length direction, the external electrodes may be disposed on both surfaces of the body in the length direction.

The coil patterns 41 and 42, the via electrode (not illustrated), and the external electrodes 80 may be formed of a metal having excellent electric conductivity. For example, the coil patterns 41 and 42, the via electrode (not illustrated), and the external electrodes 80 may be formed of silver (Ag), copper (Cu), nickel (Ni), aluminum (Al), alloys thereof, or the like. The coil patterns 41 and 42, the via electrode (not illustrated), and the external electrodes 80 may be formed of the same material as each other or different materials from each other.

According to the exemplary embodiment, the coil patterns 41 and 42 may be covered by an insulating layer 30. The insulating layer 30 may be formed by a method known in the art such as a screen printing method, an exposure and development method using a photo resist (PR), a spray application method, or the like. The coil patterns 41 and 42 may be covered by the insulating layer 30, and thus the coil patterns 41 and 42 may not directly contact the magnetic material contained in the body 50.

Figure 5:
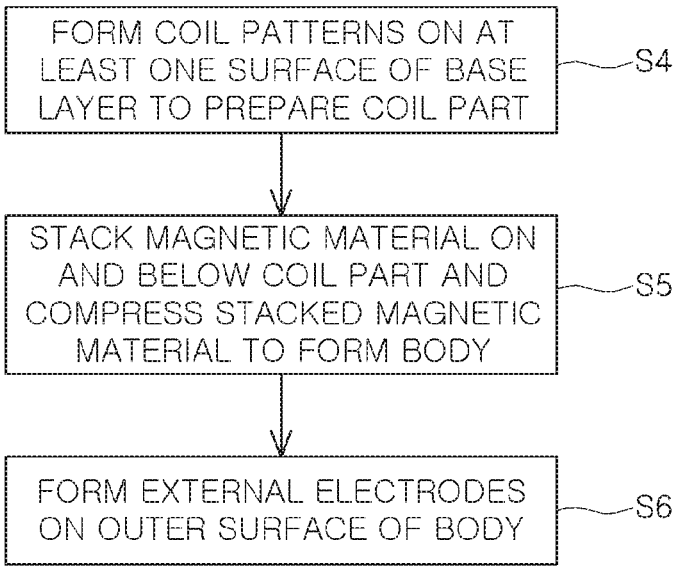
FIG. 5 is a flow chart illustrating a method of manufacturing a coil electronic component according to an exemplary embodiment in the present disclosure.

FIG. 5 is a flow chart illustrating a method of manufacturing a coil electronic component according to an exemplary embodiment in the present disclosure.

Referring to FIG. 5, the method of manufacturing a coil electronic component according to the exemplary embodiment may include forming coil patterns on at least one surface of a base layer to forma coil part (S4), and stacking a magnetic material on and below the coil part and compressing the stacked magnetic material to form a body (S5).

Meanwhile, the method of manufacturing a coil electronic component according to the exemplary embodiment may further include, after the forming of the body, forming external electrodes on an outer surface of the body (S6).

The forming of the coil part (S4) may include forming a plating resist having an opening for forming a coil pattern on a base layer 20. As the plating resist, which is a general photosensitive resist film, a dry film resist, or the like, may be used, but the plating resist is not limited thereto.

The coil patterns 41 and 42 may be formed by providing an electrically conductive metal in the opening for forming a coil pattern using an electroplating method, or the like.

The coil patterns 41 and 42 may be formed of a metal having excellent electric conductivity. For example, the coil patterns 41 and 42 may be formed of silver (Ag), palladium (Pd), aluminum (Al), nickel (Ni), titanium (Ti), gold (Au), copper (Cu), platinum (Pt), alloys thereof, or the like.

The coil part 40 in which the coil patterns 41 and 42 are formed on the base layer 20 may be formed by removing the plating resist using a chemical etching method, or the like, after forming the coil patterns 41 and 42.

A via electrode (not illustrated) may be formed by forming a hole in a portion of the base layer 20 and providing a conductive material in the hole, and the coil patterns 41 and 42 formed on one surface and the other surface of the base layer 20 may be electrically connected to each other through the via electrode.

The hole penetrating through the base layer may be formed in a central portion of the base layer 20 by a drilling method, a laser method, a sand blasting method, a punching method, or the like.

Selectively, after the coil patterns 41 and 42 are formed, an insulating layer 30 covering the coil patterns 41 and 42 may be formed. The insulating layer 30 may be formed by a method known in the art such as a screen printing method, an exposure and development method using a photo resist (PR), a spray application method, or the like, but a formation method of the insulating layer 30 is not limited thereto.

Next, the body 50 may be formed by disposing the magnetic material on and below the base layer 20 on which the coil patterns 41 and 42 are formed.

The magnetic material may be disposed on and below the base layer in a form of a magnetic layer. As the magnetic layer, a plurality of magnetic layers may be disposed on and below the base layer, or a single magnetic layer may be disposed on and below the base layer, respectively.

The body 50 may be formed by stacking the magnetic layers on both surfaces of the base layer 20 on which the coil patterns 41 and 42 are formed and compressing the stacked magnetic layers using a lamination method or isostatic pressing method. In this case, a core part 55 may be formed by filling the hole with the magnetic material.

Here, the magnetic layer may contain a magnetic paste composition for a coil electronic component, wherein the magnetic paste composition for a coil electronic component may contain the magnetic powder according to the exemplary embodiment described above.

Since, among the description of the method of manufacturing a coil electronic component according to the exemplary embodiment, a description of the magnetic powder contained in the coil electronic component described above may be equally applied, a detailed description thereof will be omitted in order to avoid an overlapping description.

Next, external electrodes 80 may be formed to be connected to the end portions of the coil patterns 41 and 42 exposed to at least one surface of the body 50.

The external electrodes 80 may be formed using a paste containing a metal having excellent electric conductivity, wherein the conductive paste may be a conductive paste containing, for example, one of nickel (Ni), copper (Cu), tin (Sn), and silver (Ag), an alloy thereof, or the like. The external electrodes 80 may be formed by a dipping method, or the like, as well as a printing method, according to a shape of the external electrodes 80.

A description of the same features as those of the above-mentioned coil electronic component according to the exemplary embodiment will be omitted in order to avoid an overlapping description.

As set forth above, according to exemplary embodiments, the magnetic powder of which the insulation properties are improved, and the manufacturing method thereof, may be provided.

Further, the coil electronic component capable of operating in a high frequency band and decreasing an eddy current loss by using the magnetic powder may be provided.

While exemplary embodiments have been shown and described above, it will be apparent to those skilled in the art that modifications and variations could be made without departing from the scope of the present invention as defined by the appended claims.

What is claimed is:

1. A magnetic powder comprising:

magnetic metal particles;

a first insulating layer disposed on a surface of each magnetic metal particle and containing silicon (Si) and oxygen (O); and a second insulating layer disposed on the first insulating layer and containing phosphorus (P), wherein an insulation resistance of each magnetic particle is $10^{11}\Omega$ or more, the first insulating layer has a thickness of 30 nm or less, and the second insulating layer has a thickness of 30 nm or less.

2. The magnetic powder of claim 1, wherein the magnetic metal particle is formed of iron (Fe) or an iron (Fe) based alloy.

3. The magnetic powder of claim 2, wherein an Fe—Si—O bond is present in an interface between the magnetic metal particle and the first insulating layer.

4. The magnetic powder of claim 1, wherein the magnetic metal particle has a particle size of 1 μm to 100 μm.

5. The magnetic powder of claim 1, wherein the first and second insulating layers have different specific electrical resistance values from each other.

6. The magnetic powder of claim 1, wherein the magnetic metal particle is completely surrounded by the first insulating layer and the first insulating layer is completely surrounded by the second insulating layer.

7. The magnetic powder of claim 1, wherein the second insulating layer further contains silicon (Si) and oxygen (O).

8. A coil electronic component comprising:

a body, in which a coil part is disposed, containing magnetic powder; and external electrodes connected to the coil part, wherein the magnetic powder includes magnetic metal particles, a first insulating layer disposed on a surface of each magnetic metal particle and containing silicon (Si) and oxygen (O), and a second insulating layer disposed on the first insulating layer and containing phosphorus (P), an insulation resistance of each magnetic particle is $10^{11}\Omega$ or more, the second insulating layer has a thickness of 30 nm or less, and the magnetic metal particle has a particle size of 1 μm to 100 μm.

9. The coil electronic component of claim 8, wherein the magnetic metal particle is formed of iron (Fe) or an iron (Fe) based alloy.

10. The coil electronic component of claim 9, wherein an Fe—Si—O bond is present in an interface between the magnetic metal particle and the first insulating layer.

11. The coil electronic component of claim 8, wherein the magnetic metal particle has a particle size of 1 μm to 100 μm.

12. The coil electronic component of claim 8, wherein the first and second insulating layers have different specific electrical resistance values from each other.

13. The coil electronic component of claim 8, wherein the magnetic metal particle is completely surrounded by the first insulating layer and the first insulating layer is completely surrounded by the second insulating layer.

14. The coil electronic component of claim 8, wherein the second insulating layer further contains silicon (Si) and oxygen (O).

* * * * *